US006727638B2

(12) United States Patent
De Paolis et al.

(10) Patent No.: US 6,727,638 B2
(45) Date of Patent: Apr. 27, 2004

(54) SHIELD FOR A TENSION MASKS IN A CATHODE RAY TUBE

(75) Inventors: Cesare De Paolis, Colleferra (IT); Goffredo Antonelli, Anagni (IT); Giuseppe Giannantonio, Anagni (IT); Paolo Ginesti, Gavignano (IT)

(73) Assignee: Thomson Licensing S.A., Boulogne Cedex (FR)

( * ) Notice: Subject to any disclaimer, the term of this patent is extended or adjusted under 35 U.S.C. 154(b) by 321 days.

(21) Appl. No.: 09/745,604

(22) Filed: Dec. 22, 2000

(65) Prior Publication Data

US 2002/0079810 A1 Jun. 27, 2002

(51) Int. Cl.[7] ..... H01J 29/80
(52) U.S. Cl. ..... 313/407
(58) Field of Search ..... 313/407, 402, 313/408

(56) References Cited

U.S. PATENT DOCUMENTS

| | | | | | |
|---|---|---|---|---|---|
| 3,601,650 | A | * | 8/1971 | Pappadis | 313/404 |
| 3,808,492 | A | * | 4/1974 | Nagao | 313/407 |
| 3,931,540 | A | * | 1/1976 | Kawamura | 313/404 |
| 2002/0180329 | A1 | * | 12/2002 | Watanabe et al. | 313/407 |

* cited by examiner

*Primary Examiner*—Jay Patidar
(74) *Attorney, Agent, or Firm*—Joseph S. Tripoli; Joseph J. Laks; Carlos M. Herrera

(57) ABSTRACT

A method and apparatus for improving magnetic shielding in mask-frame-assemblies. The system includes providing a cathode ray tube, a mask frame assembly disposed within the cathode ray tube and at least one magnetic shield disposed on the edge of the mask frame assembly. These magnetic shields provide shielding for the horizontal component of the terrestrial magnetic field and thus reduces distortion in the picture displayed on the tube.

19 Claims, 4 Drawing Sheets

SHIELD FOR A TENSION MASKS IN A CATHODE RAY TUBE

This invention generally relates to color picture tubes and, more particularly, to a method and apparatus that provides magnetic shielding in color picture tubes.

BACKGROUND OF THE INVENTION

A color picture tube includes an electron gun for generating and directing three electron beams to a screen of the tube. The screen is located on the inner surface of the faceplate of the tube and is made up of an array of elements of three different color-emitting phosphors. A color selection electrode, also referred as a shadow mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

The geometries of tension shadow masks typically include the following: (1) a near cylindrical profile with a near circular profile along the x-axis and a linear profile along the y-axis; or (2) a planar or near planar profile with a linear or near linear profile along the x-axis and a linear profile along the y-axis.

The new generation of tensioned shadow masks has a gap on the short sides of the mask between the mask and the mask frame. The gap is the product of the tension mask being mounted to a set of termination bars that are affixed to standoffs that connect the mask to the mask frame. This gap allows a horizontal component of the earth's magnetic field to effect the propagation of the electron beam. The magnetic field causes a depreciation in performance in the horizontal component areas of the screen of the television set. The amount of magnetic field penetration is known as shielding efficiency. Therefore, improved shielding is needed to eliminate or, at least, mitigate the intrusive magnetic field to produce a commercially viable television tube.

SUMMARY OF THE INVENTION

The present invention provides a method and apparatus for providing magnetic shielding in a tension mask of a color picture tube and in particular, a tube with a flat front profile. The apparatus comprises two magnetic shields that are affixed to the short sides of a mask frame assembly. These shields are formed of sheet metal and are rectangular in shape. Each of the shields contains a hole and several slots disposed through the material to aid in aligning and mounting the shields to a mask frame. The shields have a specific length, width, height and thickness, where the thickness of the sheet metal is very small compared to both the length, width and height of the shield.

The method comprises mounting the aforementioned shields to a mask frame. A shield is placed on each of the two short sides of a mask frame. The shields cover a portion of the mask frame that runs from the top of the short sides of the mask frame to the bottom of the short sides of the mask frame. A set of retaining clips are affixed to the mask frame and guide the shield into correct alignment. The retaining clips pass through slots that are disposed in the shield and temporarily secure the shields to the mask frame assembly. A rivet is placed through a hole formed in the shield and a hole formed in the mask frame to permanently affix the shield to the mask frame. The shield is affixed such that it covers the gap produced by the tension mask being mounted to standoffs affixed to the mask frame. Each of the shields covers the gap between the mask frame and the tension mask and extend slightly above or in front of the tension mask assembly. By covering the gap formed between the tension mask and the mask frame, a magnetic field protection system is realized that provides a higher shielding efficiency for the horizontal component of the terrestrial magnetic field. This invention improves shielding efficiency upwards of 40%.

DETAILED DESCRIPTION

Figure 1:
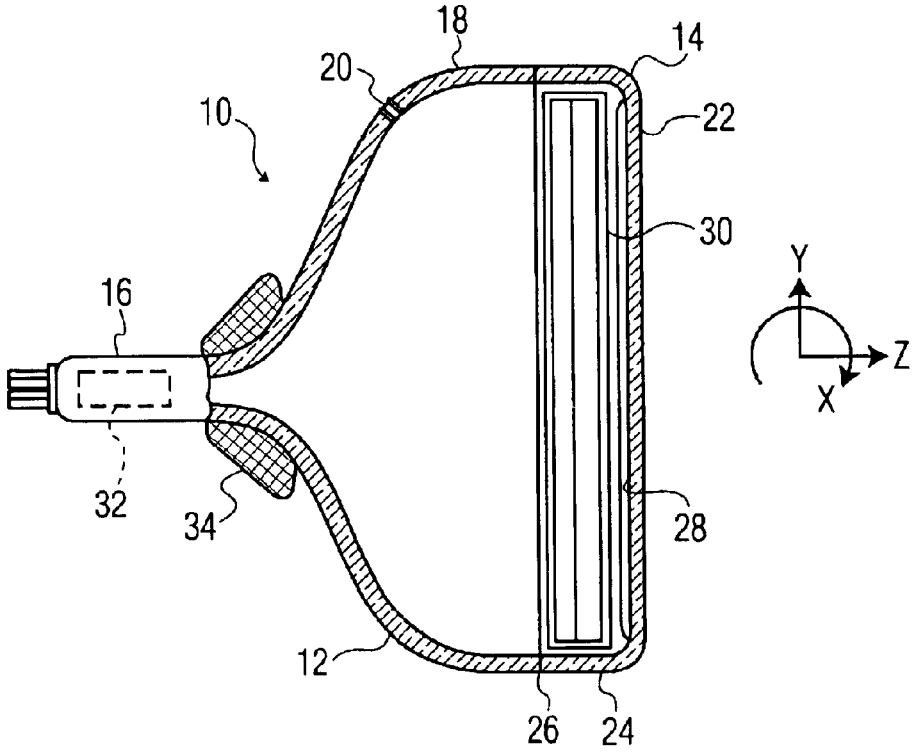
FIG. 1 is a side view, partially in the axial section, of a color picture tube, including a tension mask-frame assembly in which the mask is planar or otherwise known as true flat.

FIG. 1 shows a cathode ray tube 10 having a glass envelope 12 that comprises a rectangular face plate panel 14 and a tubular neck 16 connected by a rectangular funnel 18. The funnel 18 has an internal conductive coating (not shown) that extends from an anode button 20 to a neck 16. The panel 14 comprises a viewing face plate 22 and a peripheral flange or sidewall 24 that is sealed to the funnel 18 by a glass frit 26. A three-color phosphor screen 28 is carried by the inner surface of the face plate 22. The screen 28 is a line screen with the phosphor lines arranged in triads, each triad including a phosphor line of each of the three colors. A mask frame assembly is removably mounted in a predetermined spaced relation to the screen 28. An electron gun 32 (schematically shown by the dashed lines in FIG. 1) is centrally mounted within the neck 16 to generate three in-line electron beams, a center beam and two side beams, along convergent paths through the mask frame assembly 30 to the 28.

The tube 10 is designed to be used with an external magnetic deflection yoke, such as the yoke 34 shown in the neighborhood of the funnel to neck junction. When activated, the yoke 34 subjects the three beams to magnetic fields that cause the beams to scan horizontally and vertically in a rectangular raster over the screen 28.

Figure 2:
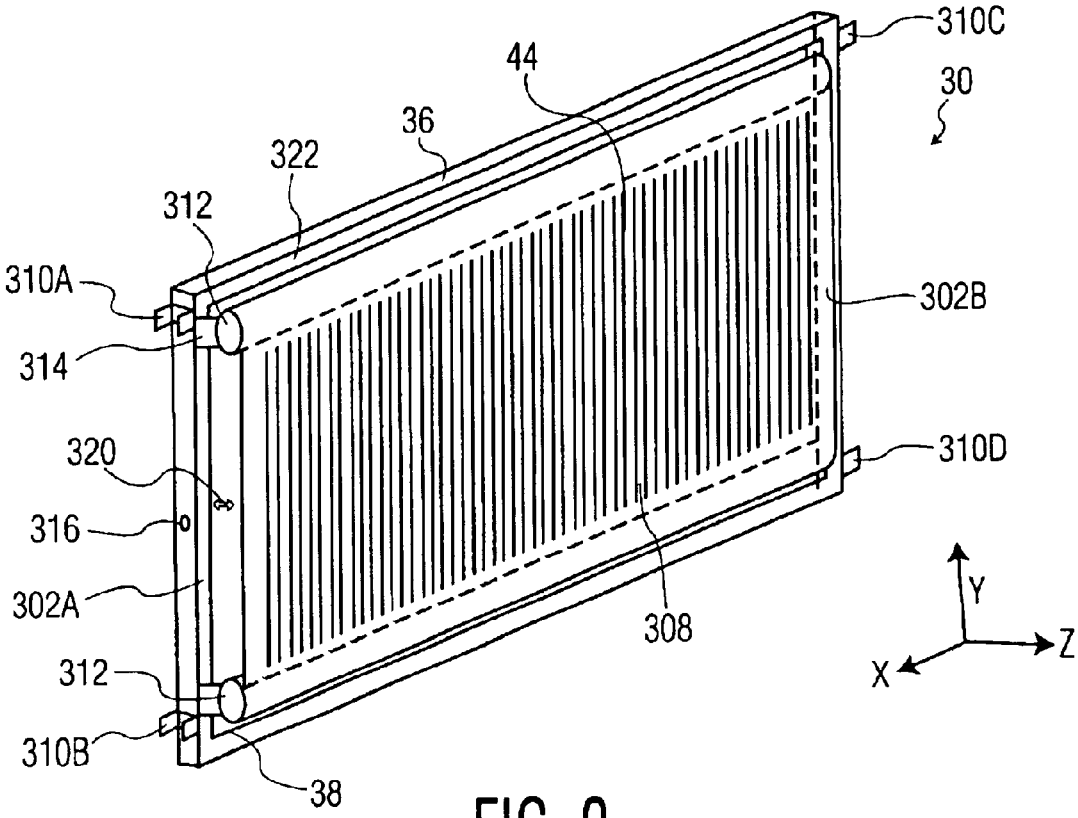
FIG. 2 is a perspective view of a tension mask of the present generation of tension masks to which the invention relates.

The mask frame assembly 30, shown in greater detail in FIG. 2, includes a mask frame 322 comprising two long sides 36 and 38 and two short sides 302A and 302B. The two long sides 36 and 38 of the mask parallel a central major axis, x, of the tube and likewise, the two short sides 302A and 302B parallel a central minor axis y of the tube. The mask frame assembly 30 includes a set of conductive lines. These are otherwise known as strands 44. They parallel the central minor axis y. The strands 44 are attached to a set of terminating bars 312 which are attached to the two short sides 302A and 302B of the mask frame assembly 30. In one embodiment, the strands 44 are flat strips that extend vertically, having a width of about 13 mils and a thickness of about 2 mils.

FIG. 2 depicts a mask frame assembly 30 that comprises two main sub assemblies, the tension mask 308 and the mask frame 322. The tension mask 308 is a sheet of material that has been etched to form strands 44 and is attached to a set of termination bars 312. The tension mask 308 is first tensioned and then attached to the mask frame 322 by a set of four standoffs 314. A noticeable gap 320 is created by the standoffs 314 between the tension mask 308 and the mask frame 322. One of the goals of the invention is to close off this gap 320 from the effects of the terrestrial magnetic field.

Figure 3:
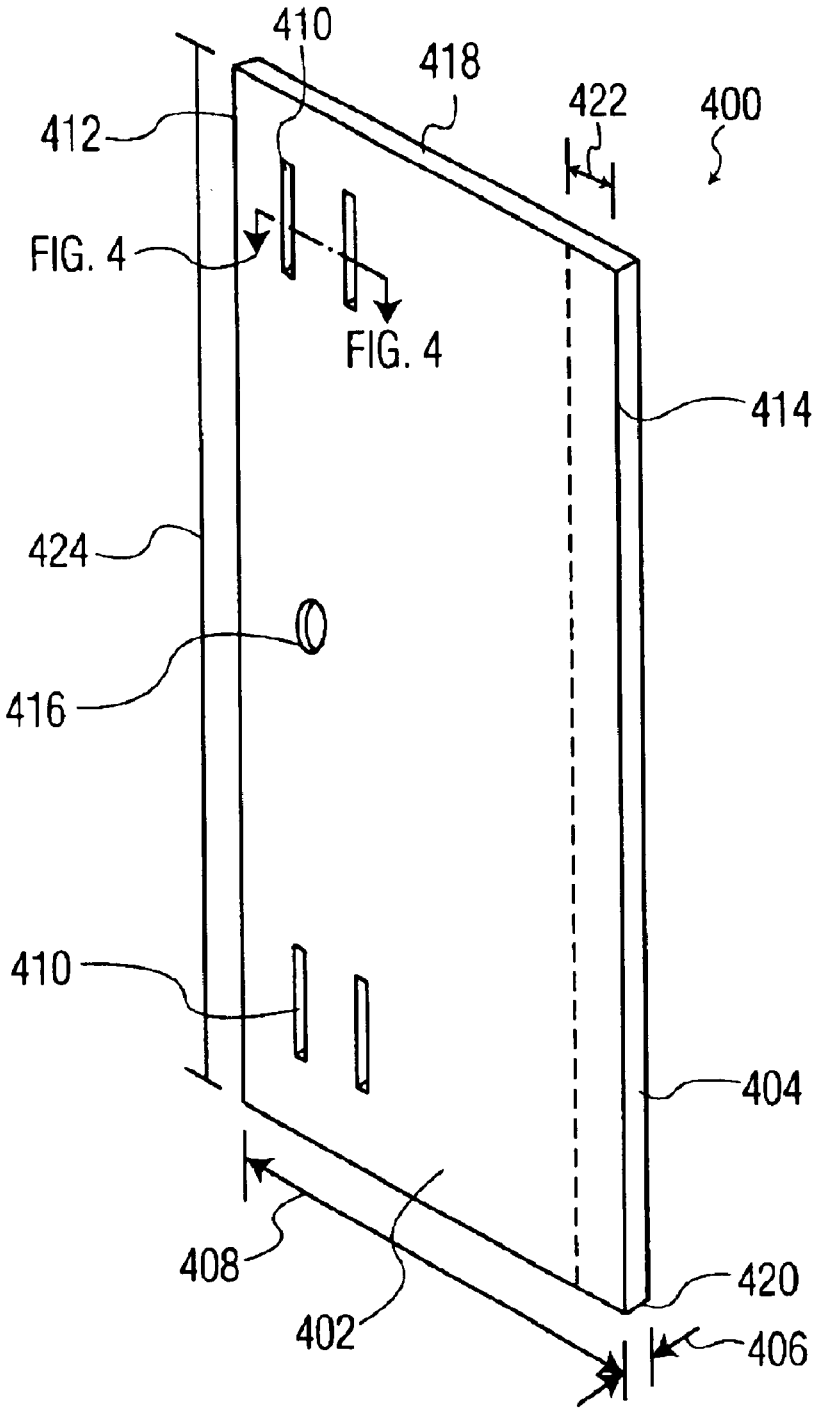
FIG. 3 is a perspective view of the magnetic shielding of the present invention.

A set of four spring clips 310A, 310B, 310C and 310D are disposed around the outer periphery of the short sides 302A and 302B of the mask frame 322 to provide an engagement mechanism that attaches the mask frame 322 to the magnetic shields of the present invention (shown as 400 in FIG. 3). The four spring clips 310A–310D have a general U-shape form. These spring clips 310A–310D may be formed of any heat resistant resilient material such as steel or INVAR®. The spring clips 310A–310D may be affixed to the mask frame 322 by spot, tack or seam welding. A small aperture 316 is disposed in the short sides 302A and 302B of the mask frame 322. The aperture 316 is formed through the short sides 302A and 302B, respectively. The apertures are formed in a circular shape so as to accept the rivet-type fastener 616 as shown in FIG. 6.

FIG. 3 is a perspective view of the magnetic shield 400 according to the present invention. The magnetic shield 400 has a front 402, a back 404, four sides 412, 418, 414 and 420, a respective thickness 406, a width 408 and respective height 424. The magnetic shield 400 may be formed of a heat resistant fero magnetic material such as steel, aluminum or copper. Features of the magnetic shield 400 include a plurality of slots 410 disposed through the magnetic shield 400 and an aperture 416 that is also disposed through the thickness of the material. The length of the magnetic shield 400 is such that its length 424 extends the length of the short sides 302A and 302B of the mask frame assembly 30. The width 408 of the magnetic shield 400 covers the gap 320 between the tension mask 308 and the mask frame 322 as well as extending above the standoff height of the tension mask 308.

Figure 4:
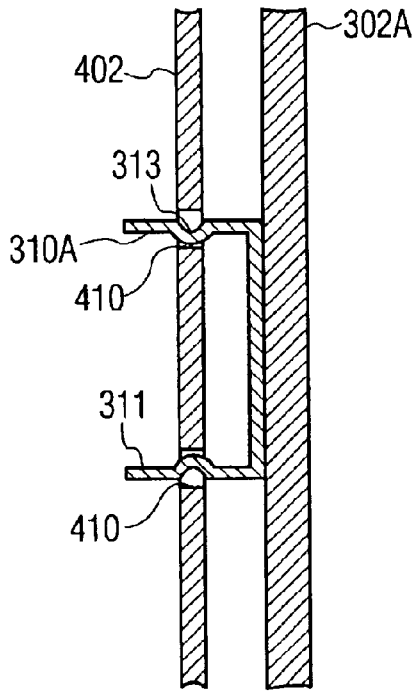
FIG. 4 is a cross-sectional view of the magnetic shield clips as attached to the magnetic shield.

The slots 410 in the magnetic shield 400 are formed to cooperate with spring clips 310A–310D that are attached to the mask frame 322. The slots 410 are designed to allow a portion 311 of the spring clips 310 to pass through the magnetic shield 400 and temporarily affix the shield 400 in place so as to align apertures 416 and 316. FIG. 4 is a cross-sectional view of the magnetic shield clips 310A as attached to the magnetic shield 400. A portion 311 of spring clip 310A protrudes through the aperture 410 of the front 402 of the magnetic shield 400. The magnetic shield 400 is held in place by detents 313 formed in the spring clip 310A. The aperture 416 is formed through the entire thickness 406 of the material of the magnetic shield 400. The aperture 416 is formed to accommodate a rivet type fastener 616 shown in FIG. 6.

Figure 5:
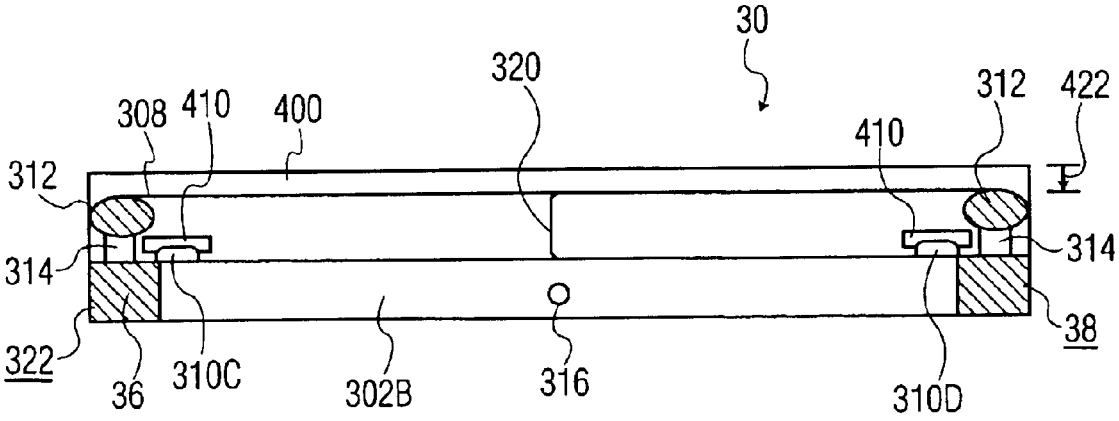
FIG. 5 is a cross-sectional view of the tension focus mask of FIG. 6 along line 5—5.
Figure 6:
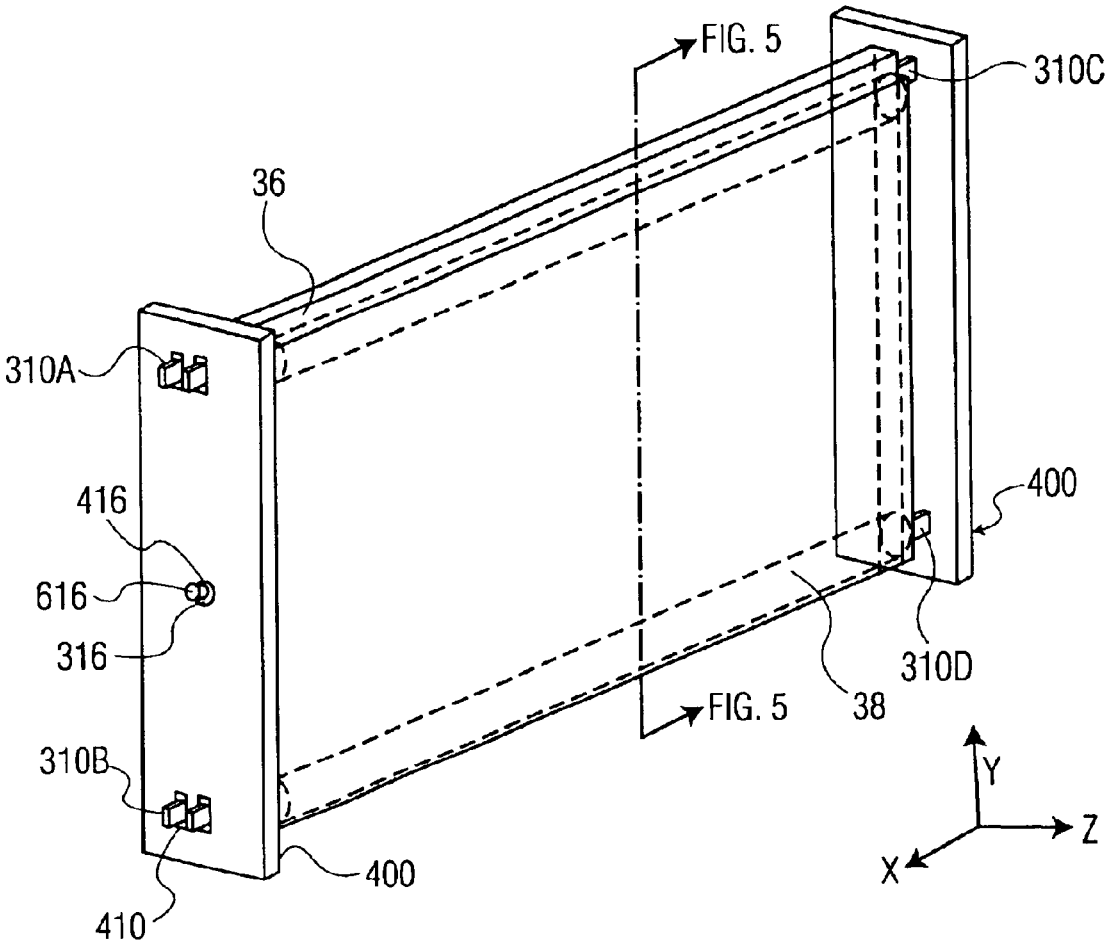
FIG. 6 is a perspective view of the tension mask of FIG. 2 incorporating the magnetic shielding features of the present invention.

FIG. 5 is a cross-sectional view of mask frame assembly 30 taken along line 5—5 as depicted in FIG. 6. FIG. 5 depicts the mask frame assembly 30 with the magnetic shield 400 installed. The magnetic shield 400 can be seen attached to the mask frame assembly 30 by spring clips 310C and 310D projecting through slots 410 disposed through the magnetic shield 400. As is clearly shown, the magnetic shield 400 covers gap 320 formed between mask frame 322 and tension mask 308. Further, magnetic shield 400 extends a distance 422 above tension mask 308. This overhang area 422 is approximately between 0.2 and 0.5 millimeters in width. This portion 422 of the magnetic shield 400 provides a significant amount of magnetic shielding in the mask frame assembly 30 that prevents the distortive effects of terrestrial magnetic fields from reaching the phosphor screen 28 of the cathode ray tube 10.

FIG. 6 is a perspective view of a mask frame assembly 30 as seen in FIG. 2 combined with the magnetic shielding 400 of FIG. 3. As can be seen in FIG. 6, the magnetic shielding 400 has been applied to the short sides 302A and 302B of the mask frame assembly 30. Clearly shown are the spring clips 310A–310D extending through slots 410 disposed on magnetic shielding 400. Also shown is a rivet 616 disposed through magnetic shielding aperture 416 and aperture 316 of the short side 302A of the mask frame 322. The magnetic shield 400 is mounted to the spring clips 310A–310D and closes the gap between mask frame 322 and tension mask 308. While the magnetic shield 400 is close to the tension mask 308, the magnetic shield 400 does not come in direct contact with the tension mask 308. The tension mask 308 does not physically touch either of the magnetic shields 400 and is electrically isolated from the mask frame 322.

As the embodiments that incorporate the teachings of the present invention have been shown and described in detail, those skilled in the art can readily devise many other varied embodiments that still incorporate these teachings without departing from the spirit of the invention.

What is claimed is:

1. An apparatus for improving magnetic shielding in a mask frame assembly comprising:

a mask frame assembly including a tension mask fixed to a mask frame such that a gap is formed between an edge of the tension mask and the mask frame; and at least one magnetic shield disposed on an edge of said mask frame assembly, the at least one magnetic shield arranged to cover the gap between the mask frame and the tension mask.

2. The apparatus of claim 1, wherein the mask frame assembly is attached to the at least one magnetic shield by a spring clip.

3. The apparatus of claim 2, wherein the spring clip is affixed to the mask frame assembly by welding.

4. The apparatus of claim 2, wherein the spring clip attaches to the at least one magnetic shield by spring force.

5. The apparatus of claim 2, wherein the at least one magnetic shield is retained by the spring clip to the mask frame by detents formed to engage the at least one magnetic shield.

6. The apparatus of claim 1, further comprising a rivet for affixing the at least one magnetic shield to the mask frame.

7. The apparatus of claim 1, wherein the at least one magnetic shield is formed of steel.

8. The apparatus of claim 1, wherein said magnetic shielding comprises two magnetic shields.

9. The apparatus of claim 1, wherein a section of the at least one magnetic shields extends away from the mask frame a distance beyond the tension mask, the distance being approximately 0.2 to 0.5-mm.

10. The cathode ray tube of claim 1, wherein the magnetic shield is secured to the mask frame by a rivot.

11. A method for providing magnetic shielding for tension masks comprising the steps of:

(a) providing at least one magnetic shield;

(b) fixing a tension mask to a mask frame such that a gap is formed between an edge of the tension mask and the mask frame to form a mask frame assembly;

(c) affixing the at least one magnetic shield to the mask frame assembly to cover the gap between the mask frame and the tension mask; and (d) inserting the mask frame assembly into a color picture tube assembly.

12. The method of claim 11 further comprising the steps of aligning the at least one magnetic shield parallel at least to an edge of the mask frame assembly prior to affixing the magnetic shield to the mask frame assembly.

13. The method of claim 11 further comprising the steps of engaging spring clips into shield apertures, and affixing the at least one magnetic shield to the mask frame.

14. A cathode ray tube, comprising:

a mask frame assembly disposed between a face plate and an electron gun, the mask frame assembly including a tension mask fixed to a mask frame, and a magnetic shield secured to the mask frame that extends toward the faceplate a distance beyond said tension mask.

15. The cathode ray tube of claim 14, wherein the distance is approximately 0.2 to 0.5 mm.

16. The cathode ray tube of claim 14, further comprising a spring clip attached to the mask frame to secure the magnetic shield therero.

17. The cathode ray tube of claim 16, wherein the spring clip temporarily secures the magnetic shield to the mask frame.

18. The cathode ray tube of claim 16, wherein the spring clip has detents that engage with the magnetic shield.

19. The cathode ray tube of claim 14, wherein the tension mask is fixed to the mask frame by a plurality of standoffs that isolate the tension mask from the mask frame.

* * * * *